United States Patent [19]

D'Silva

[11] Patent Number: 4,515,535

[45] Date of Patent: May 7, 1985

[54] PERISTALTIC PUMP QUICK DISCONNECT ROTOR ASSEMBLY

[75] Inventor: Edmund D. D'Silva, Round Lake Beach, Ill.

[73] Assignee: Baxter Travenol Laboratories, Inc., Deerfield, Ill.

[21] Appl. No.: 523,496

[22] Filed: Aug. 15, 1983

[51] Int. Cl.[3] ..... F04B 17/00; F04B 43/12

[52] U.S. Cl. ..... 417/360; 417/420; 417/477; 403/DIG. 1

[58] Field of Search ..... 417/360, 420, 477; 403/DIG. 1, 380, 345; 464/29

[56] References Cited

U.S. PATENT DOCUMENTS

| | | | |
|---|---|---|---|
| 2,630,036 | 3/1953 | Brown | 403/DIG. 1 X |
| 2,718,806 | 9/1955 | Clark | 403/DIG. 1 X |
| 2,750,828 | 6/1956 | Wendling | 403/DIG. 1 X |
| 2,912,249 | 11/1959 | Eckeld | 403/DIG. 1 X |
| 3,502,034 | 3/1970 | Pickup | 417/477 |
| 3,622,252 | 11/1971 | Pickup | 417/477 |
| 3,644,061 | 2/1972 | McFarlin | 417/420 X |
| 3,970,407 | 7/1976 | Uffman | 403/DIG. 1 X |
| 4,195,542 | 4/1980 | Zimmer | 403/DIG. 1 X |
| 4,350,646 | 9/1982 | Baus | 417/420 X |

*Primary Examiner*—Richard E. Gluck

*Attorney, Agent, or Firm*—Paul C. Flattery; Robert A. Benziger

[57] ABSTRACT

The present invention provides an uncomplicated quick disconnect rotor assembly for peristaltic pumps. The assembly includes a magnetic carrier mounted on the pump drive shaft which has a mating configuration with a recess in the rotor. The rotor includes at least one magnet, preferably with segments on opposite sides of an axial drive shaft alignment passageway. The carrier and rotor are assembled and held in operation only with the magnetic force therebetween, which eliminates tools and mechanical moving parts from the assembly.

3 Claims, 6 Drawing Figures

PERISTALTIC PUMP QUICK DISCONNECT ROTOR ASSEMBLY

BACKGROUND OF THE INVENTION

The present invention relates to an improved peristaltic pumping system. More particularly, the present invention is directed to an improved quick disconnect coupling for a peristaltic pump rotor.

When utilized to pump fluids, it is necessary that the pump rotors be removed so that the rotor rollers can be cleaned to insure a proper pumping operation. This is most especially true when the fluids are being fed into a patient. The rollers can become clogged in numerous ways, such as from fluid spillage from outside the pumping system, by leakage from fluid in the fluid tubing or when changing the fluid tubing.

The prior art discloses a variety of peristaltic pump rotor engagement devices. One conventional type of rotor is engaged to the rotor device shaft by a set screw, threadly engaged through one side of the rotor. The set screw typically requires a special tool or wrench for inserting and removing the set screw. The set screw can easily be misplaced if completely disengaged from the rotor. Further, the set screw can be misaligned on the drive shaft which can cause slippage of the rotor and hence intermittent or failure operation.

Another conventional type of rotor is engaged to the rotor drive shaft by a spring loaded detent mechanism which is aligned with an annular groove on the rotor drive shaft. This type of rotor generally includes a key or flat portion which is matched to a complimentary portion on the drive shaft to prohibit slippage. This system does not require a special tool, but can be misaligned and the spring mechanism can be clogged and can mechanically wear out so as to prevent proper engagement of the rotor on the drive shaft.

It therefore would be desirable to provide a rotor coupling assembly which provides both easy and positive alignment and engagement and disengagement of the rotor and the rotor drive shaft without tools and mechanical parts which can clog or wear out. This is especially true with a system which is intended for use in a home or other environment by relatively unskilled operators.

SUMMARY OF THE INVENTION

In accordance with the present invention, a rotor coupling assembly is provided to quickly and easily disconnect and reconnect the rotor of a peristaltic pump in proper alignment and without tools.

The assembly includes a carrier formed from magnetic material secured to the pump drive shaft. The rotor includes a recess which is aligned with the carrier and shaft to provide a positive engagement of the rotor, carrier and shaft. The rotor includes at least one magnet which provides the connecting force to retain the assembly in proper alignment during operation.

DETAILED DESCRIPTION OF THE PREFERRED EMBODIMENTS

Figure 1:
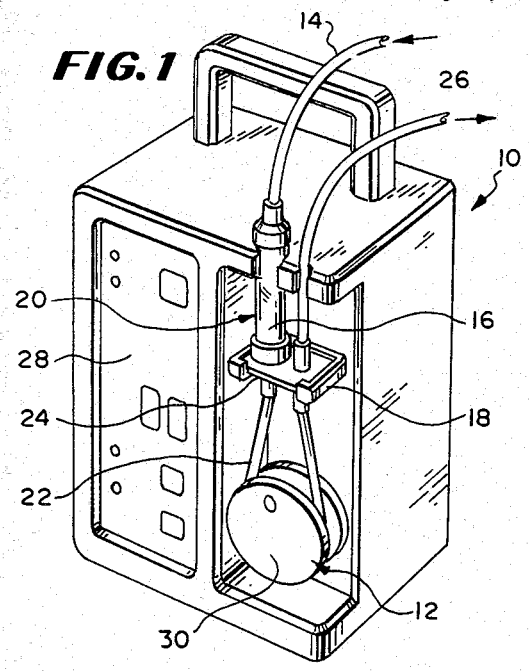
FIG. 1 is a perspective view of a peristaltic pump with the rotor assembly of the invention mounted thereon.

Referring to FIG. 1, there is shown a peristaltic pumping system 10, which can incorporate the present invention of a rotor assembly 12. The system 10 includes a fluid line 14 coupled to a fluid source (not shown) which delivers fluid to a drip chamber 16. The drip chamber 16 can be of any conventional design and can be eliminated or replaced in systems which are not designed to feed solutions to patients.

The system 10 includes a holder 18 which is designed to secure a fluid tubing set 20 in proper alignment with the rotor assembly 12. The set 20 typically includes at least the fluid line or tubing 14, the drip chamber 16, a rotor engaging tubing segment 22 which is engaged around a rotor 30 of the rotor assembly 12, a set retainer or bridge 24 which is engaged into the set holder 18 and a feeding tube 26 which can be coupled to a patient. The system 10 also includes a control panel 28 to control and monitor the system operation. In operation, the rotor 30 rotates and provides a compression of the tubing 22 to move the fluid to the tube 26 by positive displacement. The holder 18 and the bridge 24 maintain the proper tension in the segment 22 around the rotor 30 for proper operation.

Figure 2:
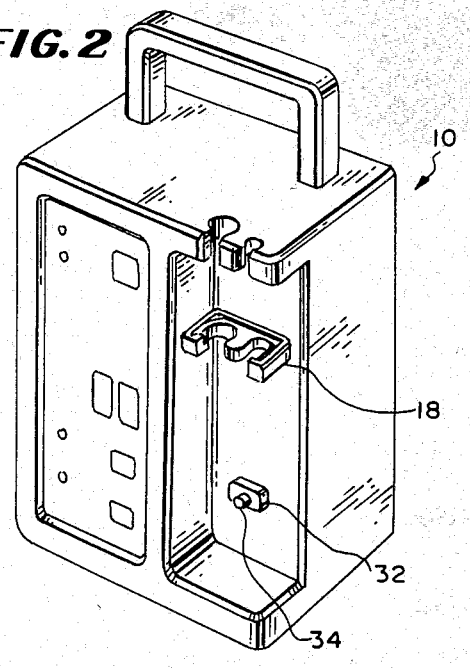
FIG. 2 is a perspective view of the pump of FIG. 1 with the rotor of the invention disconnected therefrom.

Referring now to FIG. 2, the system 10 is illustrated with the set 20 and the rotor portion 30 of the rotor assembly 12 removed from the system 10. The remaining portion of the rotor assembly 12 is a carrier 32, which is formed of a magnetic material and is affixed to a drive shaft 34 of the system 10.

Figure 3A:
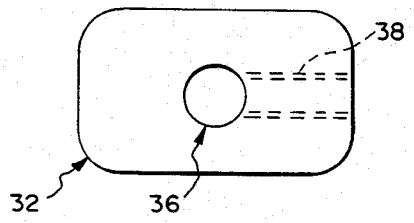
FIG. 3A is a plan view of one embodiment of the rotor carrier of the invention.
Figure 3B:
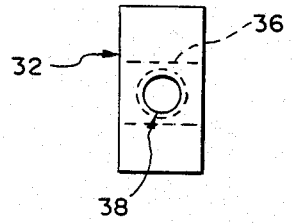
FIG. 3B is a side view of the carrier of FIG. 3A.

As best illustrated in FIGS. 3A and 3B, the carrier 32 has an elongated shape which is utilized as a key for the rotor 30 as will be described with respect to FIGS. 4A and 4B. The carrier 32 includes an axial passageway 36 which is configured to slidingly engage the drive shaft 34 which extends therethrough. The carrier 32 further includes a threaded passageway 38 into which is threaded a set screw (not shown) to fix the carrier 32 onto the shaft 34. The shaft 34 preferably includes a keyway (not shown) which mates with the set screw in a conventional manner to fix the position of the carrier 32 on the shaft 34. The carrier 32 can be mounted on the shaft 34 at the factory and does not have to be removed for cleaning because there are no moving parts in the carrier 32.

Figure 4A:
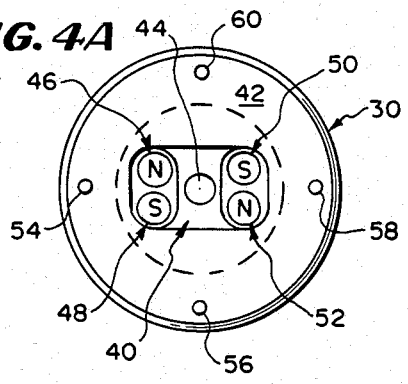
FIG. 4A is a plan view of one embodiment of the rotor of the invention.
Figure 4B:
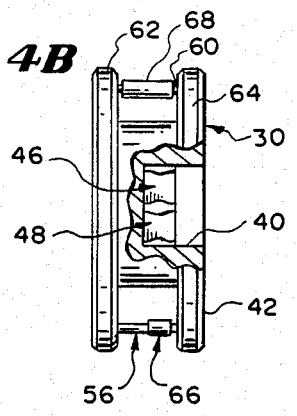
FIG.4B is a side view partially in section of the rotor of FIG. 4A.

Referring now to the rotor 30, best illustrated in FIGS. 4A and 4B, a recess 40 is formed in a back face 42 of the rotor 30. The recess 40 is shaped and dimensioned to closely engage the carrier 32 when the rotor 30 is mounted on the carrier 32 and shaft 34. This provides a positive torque assembly. The rotor 30 preferably also includes an axial passageway 44 which also engages the shaft 34 and provides an alignment guide for the assembly 12. The passageway 44 preferably does not extend clear through the rotor 30 so that the front face of the rotor is formed without openings therein.

The rotor 30 can be formed from any desired material and has recessed behind the recess 40 at least one and preferably four magnets 46 and 48, 50 and 52. The magnets are preferably oriented with the magnets 46 and 52 in one N-S orientation, (FIG. 4A being an end view) and the magnets 48 and 50 oppositely S-N oriented. This avoids any weakening of the retaining force from the carrier 32 becoming magnetized, which could occur if magnets 46 and 48 were oppositely oriented to magnets 50 and 52. This also can be avoided by configuring the carrier 32 so that the rotor 30 only fits in one orientation and then one or a pair of magnets can be utilized on opposite sides of the passageway 44. The magnetic retaining force provided, preferably is in the range of 0.5 to 5 pounds, and most preferably between 0.9 and 4.2 pounds. The passageway 44 and shaft 34 assist in the holding force since they prevent a tilting away of the rotor 30 from the carrier 32.

The magnets 46, 48, 50 and 52 can be retained in any convenient manner, but preferably are cemented in by a silicon rubber compound since press fitting requires closer tolerances of the parts and increases cost. The rotor 30 preferably is a roller type which includes at least three and preferably four roller shafts 54, 56, 58 and 60. The shafts are each mounted axially around the rotor 30 between a front annular flange 62 and a rear flange 64. Each of the shafts 54, 56, 58 and 60 include a roller mounted thereon, two of which 66 and 68 are illustrated in FIG. 4B mounted respectively on the shafts 56 and 60.

The shafts 54, 56, 58 and 60 preferably are mounted through the flange 64 and into the flange 62. The rollers and shafts can be formed of any convenient materials which will provide a relatively frictionless surface therebetween. As can be seen, however, the rollers can be clogged with fluids which leak from the set 20 during a leak in operation or removal or are spilled thereon. Thus, as previously mentioned, the requirement for easy removal of the rotor assembly 12 as provided by the invention herein.

Modifications and variations of the present invention are possible in light of the above teachings. The system 10 described for example, is not critical and the rotor 30 can be of any size and type, utilized in any peristaltic pumping system. The carrier 32, as previously described can be of any dimension and shape to mate with a like shaped recess 40 in the rotor 30. A single annular magnet can be utilized which can surround the passageway 44 and can have polarized segments to insure that the retaining force is maintained. Further, the functions of the rotor 30 and the carrier 32 can be reversed to have a recess in the carrier 32 and a complimentary extruded portion in the rotor 30. Also, the rotor 30 could contain the magnetic material and the magnet or magnets could be contained in the carrier 32. It is therefore to be understood that within the scope of the appended claims the invention may be practiced otherwise than as specifically described.

What is claimed and desired to be secured by Letters Patent of the United States is:

1. An improved quick disconnect rotor assembly for peristaltic pumps, comprising:

a carrier having a first configuration and being attachable to a pump drive shaft, said carrier being formed with first magnetic means; and a rotor having means defining a second configuration which mates with said first configuration when said carrier and said rotor are mounted together in either a first orientation or a second orientation spaced 180 degrees from said first orientation, said rotor mating means further having second magnetic means therein for magnetically coupling with said first magnetic means when said carrier and said rotor are mounted together in one of said first and second orientations, said second magnetic means including first and second magnets, each presenting a north magnetic pole, and third and fourth magnets, each presenting a south magnetic pole, said magnets being equally radially spaced from the center of said rotor mating means with said first magnet diametrically oppositely spaced from said second magnet and said third magnet diametrically oppositely spaced from said fourth magnet.

2. The assembly as claimed in claim 1 wherein:

said rotor mating means include a recess having said second configuration adapted to closely engage said carrier first configuration when said carrier and rotor are mounted together in one of said first and second orientations.

3. The assembly as claimed in claim 1 wherein:

said carrier includes an axial passageway adapted to fit over said drive shaft.

* * * * *